US005918879A

United States Patent [19]

Steinhilber

[11] Patent Number: 5,918,879

[45] Date of Patent: Jul. 6, 1999

[54] METHOD AND DEVICE FOR SEPARABLY DEPOSITING SHEETS IN A STACK

[76] Inventor: Friedhelm Steinhilber, Schauinslandweg 13, 78628 Rottweil, Germany

[21] Appl. No.: 08/856,293

[22] Filed: May 14, 1997

[30] Foreign Application Priority Data

Oct. 2, 1996 [DE] Germany ..... 196 40 657

[51] Int. Cl.[6] ..... B41F 13/54

[52] U.S. Cl. ..... 271/279; 270/52.02

[58] Field of Search ..... 270/52.02, 52.03, 270/59, 58.04; 271/3.05, 279

[56] References Cited

U.S. PATENT DOCUMENTS 4,248,528 2/1981 Sahay .
4,763,161 8/1988 Forest et al. .
4,974,035 11/1990 Rabb et al. ..... 355/320
5,316,279 5/1994 Corona et al. ..... 271/9
5,704,602 1/1998 Taylor et al. ..... 270/52.02

*Primary Examiner*—David A. Bucci
*Assistant Examiner*—Gregory A. Morse
*Attorney, Agent, or Firm*—Higgs, Fletcher & Mack LLP; Bernard L. Kleinke

[57] ABSTRACT

The device includes a magazine for storing divider films to separate sheets output by an office machine and deposited directly in stacks, wherein the divider films are placed between discrete groups of associated sheets. In order to be able to associate the sheet groups separated by the divider films with particular users of the office machine, different types of divider films, for example differently colored divider films, are used. The different types of divider films are identified by an automatically detectable identifying code and are deposited onto the sheet stack according to this identifying code.

20 Claims, 3 Drawing Sheets

METHOD AND DEVICE FOR SEPARABLY DEPOSITING SHEETS IN A STACK

TECHNICAL FIELD

The present invention relates in general to a method and device for separably depositing sheets in a stack. The invention more particularly relates to a method and a device for separably depositing sheets which are output by an office machine in a stack.

BACKGROUND ART

A method and device for separably depositing sheets in a stack are described in U.S. patent application Ser. No. 08/856357 entitled "METHOD AND DEVICE FOR SEPARABLY DEPOSITING SHEETS IN A STACK", filed concurrently with the present application on May 14, 1997, said application being incorporated by reference as if fully set forth herein. Therein, a method and device are disclosed for enabling imprinted sheets output by an office machines, such as a printer, telecopier, copier, etc., to be stacked one on top of the other with the sheets belonging to different processes or print jobs being separated one from the other by divider films. The divider films are placed onto the stack from a magazine deposit on the office machine after the particular process is completed to facilitate the identification of the stacked print jobs. At least one dimension of the divider films is greater than the corresponding dimension of the deposited sheets so that the divider films project laterally from the stack.

The divider films permit the simple division of the stack into associated sheet groups corresponding to the print jobs. Any sheet group can be removed from the stack in order to further process it individually. The divider films can be reused so that the divider film removed from the stack with the associated sheet group, can be placed back into the magazine and be used again.

To find a group of sheets associated with a specific process from the stack of separated sheet groups, it is necessary to manually search through the deposition stack until the desired sheet group is observed. The divider films projecting from the stack facilitate the search since the entire stack can be leafed through, group by group, with aid of the divider films.

Although the disclosed method and device greatly facilitate the separation of the stack of sheet groups so that selected sheet groups can be readily removed from the stack, identifying a particular group in a thick stack having a large number of deposited sheet groups belonging to different processes can be tiresome and time consuming.

Therefore, it would be highly desirable to have a new and improved method and device for separably depositing sheets in stack, wherein individual groups of sheets can be identified quickly and easily.

SUMMARY OF THE INVENTION

Therefore, the principal object of the present invention is to provide a new and improved method and device for separably depositing sheets in a stack such that individual groups of sheets can be readily identified in a quick and convenient manner.

Briefly, the above and further objects of the present invention are realized by providing a new and improved device for separably depositing sheets in a stack, which can be used in accordance with a novel method of the present invention.

The device includes a magazine for storing divider films to separate sheets output by an office machine and deposited directly in stacks, wherein the divider films are placed between discrete groups of associated sheets. In order to be able to associate the sheet groups separated by the divider films with particular users of the office machine, different types of divider films, for example differently colored divider films, are used. The different types of divider films are identified by an automatically detectable identifying code and are deposited onto the sheet stack according to this identifying code.

The present application resides in a method and a device for facilitating the search for sheet groups belonging to a specific process in a stack of sheets output by an office machine.

The essential inventive concept resides in using different types of divider films which can be assigned to the different processes. The different types of divider films can be recognized readily in the deposited stack on the basis of their differentiating features so that in conjunction with the different types of divider films, the sheet group associated with a specific process can be rapidly detected in the stack and removed from it.

The simplest and most readily detectable differentiating feature of the various types comprises using divider films having areas of unique colors to differentiate the divider films from one another. Apart from the noticeable differentiability based on the different colors, the different types of the divider film are substantially identical in shape and material. This provides an additional advantage wherein the handling of the different types of divider films is not affected by the ability to differentiate among them.

The differentiating of the divider films is especially useful for arrangements wherein a plurality of work stations are connected to, and share a common central printer. Individual print jobs for printed documents requested by the various users at their respective work stations can be identified by a specific color of divider films assigned to each user. Based on these colored divider films, the particular user can readily recognize the assigned color, and thus the corresponding sheet groups, and remove them from the stack.

So that each deposited sheet group, which can also comprise a single sheet, is assigned a divider film of the type which corresponds to that sheet group for which the user is responsible, the control signal which triggers the deposition of a divider film contains data about which type of divider film is to be deposited. If, for example, the invention is applied in connection with the sheet deposition of a printer, a command is added to the print command for the particular print job regarding the type of divider film preferably to be deposited onto the stack at the start and the output of the printed sheets of the print job. By means of this control signal, a divider film of the selected type is subsequently placed from the magazine onto the sheet stack.

In order to pull the particular selected type of divider film from the magazine and place it onto the stack, the different types of divider films can be stacked and stored separately in the magazine. The control signal selects the stack from which the divider film is removed. However, this solution presupposes that in the magazine a number of stacks corresponding to the number of different types of divider films is stored and that the magazine comprises a selection device in order to be able to select under control a stack. This leads to considerable constructional expense and space requirement, in particular if a relatively large number of different types of divider films are to be used. Moreover, the divider films must be placed back into the magazine after they have been sorted according to type which requires appropriate care on the part of the users.

It is therefore preferred to provide the different types of divider films with a code identifying its type, which can be detected automatically. The divider films can therefore be placed in unsorted sequence back into the magazine and the selected type of divider film can be detected automatically in the magazine, and supplied therefrom, according to the control signal. In order to facilitate this search process, and in particular the removal of the divider films from the magazine, it is useful to remove the divider films stored in random sequence in the magazine sequentially from the magazine with their code being checked automatically each time.

The divider film codes are compared with the selection command of the control signal. If the identified type of divider film does not agree with the selection command of the control signal, the divider film is guided back into the magazine. This is continued until a divider film is detected which corresponds to the selection command of the control signal. This matching divider film is subsequently deposited on the stack of the deposited sheets and the process is terminated until the next control signal occurs.

The automatically detectable code identifying the type of divider film can be implemented in various ways. It is possible, for example, to determine the color of the divider film by means of a color sensor. In this regard, the color used for the differentiation of the various types of divider films used by the user can also be used simultaneously as the identifying code for the output of the divider films from the magazine. Such color sensors, however, are expensive if a relatively large number of different colors is to be identified reliably.

Therefore, digital coding is preferably used as identification. This digital coding can be applied in the form of perforations or in the form of an imprint, which is scanned optically by an appropriate sensor. This digital coding is usefully applied in concentric rings on the divider films. The use of circular disk-form divider films which can be placed back into the magazine without preferred orientation are especially suitable. The disposition of the coding in concentric rings permits scanning the coding in any angular region so that the scanning does not depend on the orientation of the divider films. The simplest form of such coding is the application of a bar code in the form of concentric rings, which in this case is scanned by a sensor in the radial direction.

In order to retain the divider films not corresponding to the control signal during the successive removal of the divider films stored in random sequence in the magazine, a shunt arrangement is disposed at the output of the magazine. The shunt arrangement is switched according to the detection of the identifying code so that the divider film is either guided along a return channel to return the divider film back into the magazine, or is guided onto the deposited stack of sheets.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein:

Referring now to FIG. 1–3, there is shown the output region of a printer 10, such as a laser printer, with output rollers 12 which eject printed sheets and deposits them on a stacking tray 16 in a stack. The printer 10 is commercially available and will not be described hereinafter in grater detail.

Figure 1:
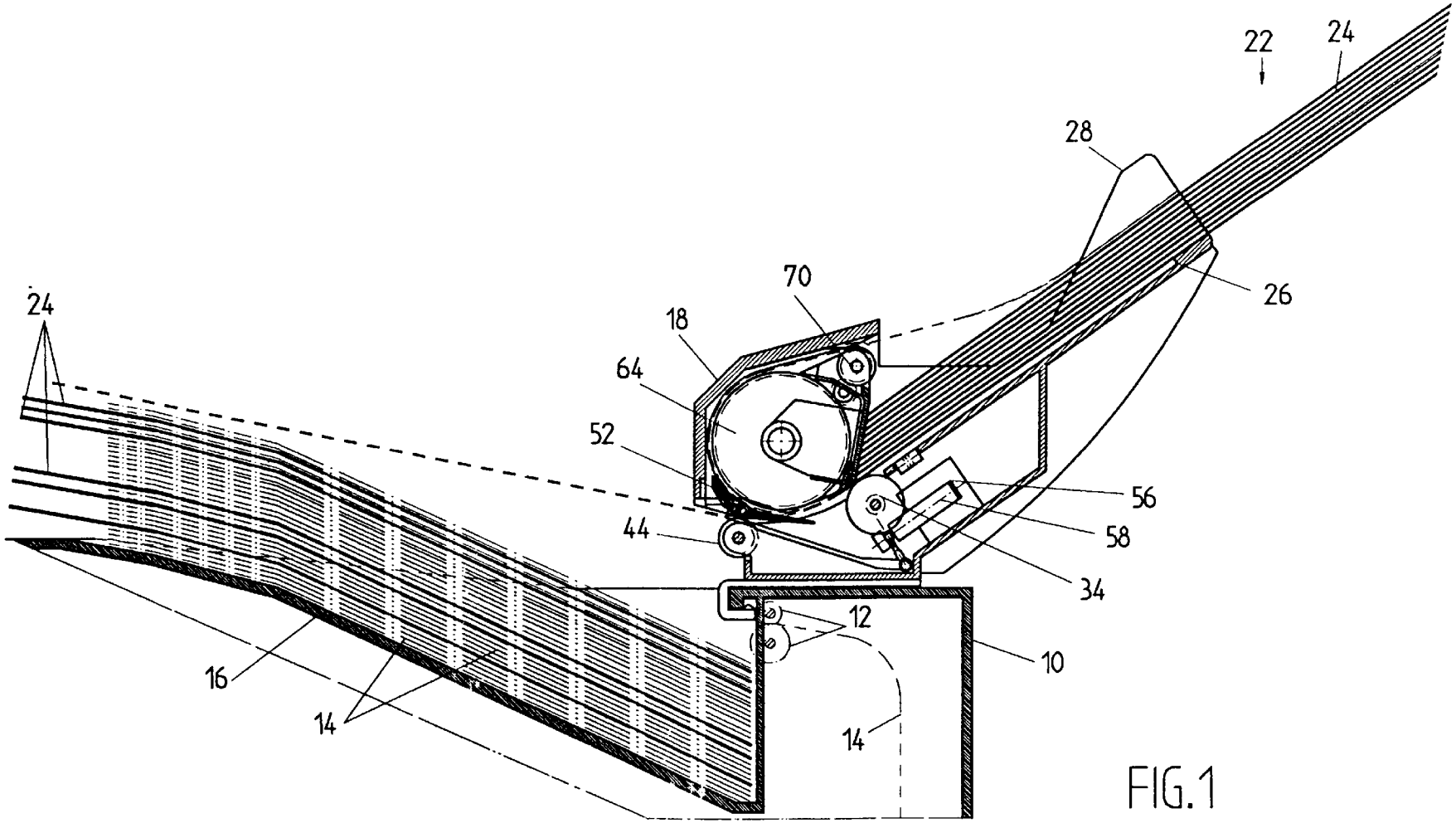
FIG. 1 is a vertical section through the device installed on a printer, which device is constructed in accordance with the present invention.

The device according to the invention is placed above the output rollers 12 onto the upper cover plate of printer 10. The device is similar to the device of the associated concurrently filed U.S. patent application Ser. No. 08/856,367, and includes a magazine 22 having an inclined bearing surface 26 for receiving and supporting divider films 24 therein. A vertical stop wall 30 prevents the divider films 24 from sliding downwardly.

A throughput channel 42 extending from about the stop wall 30 to an output end of the magazine 22 permits the divider films 24 to be transported from the magazine 22 to the paper stack on the tray 16. Separating rollers 34 on shaft 32 engage the lowermost divider sheet on the bearing surface 26 and urge the divider sheet into the throughput channel 42.

The present invention device further includes a shunt 52 disposed at the output end of the throughput channel 42, where lower ejection rollers 44 and upper ejection rollers 50 are located. The shunt 52 comprises sheet guidance elements which are supported pivotably about the axle for the upper ejection rollers 50, and are disposed axially between the upper ejection rollers 50 on their axles. The sheet guidance elements of shunt 52 include a tongue 54 directed toward the magazine 22, for selectively diverting divider films 24 passing through the throughput channel 42. In this regard, the shunt 52 is pivot to position the tongue 54 in the channel 42 (FIG. 3), or is pivoted to position the tongue 54 out of the throughput channel 42 (FIG. 2) so that the shunt 52 exposes the throughput channel 42.

For pivoting shunt 52, an electromagnet 56 is disposed underneath the bearing surface 26 of magazine 22. A plunger 58 coupled to the electromagnet 56 engages an arm of an angle lever 60 supported pivotably in the housing 18. The other arm of the angle lever 60 engages from below the shunt 52. An axial motion of the plunger 58 thus causes the pivoting of angle lever 60, which in turn causes the pivoting of shunt 52. The electromagnet 56 is actuated via a control signal in a manner to be described later.

A motor 38 drives via the toothed gearing 48 a gear disposed on a shaft 46 of the lower ejection rollers 44, which, in turn, drives a gear disposed on the axle of the upper ejection rollers 50. In the housing 18, transport rollers 64 are supported on a horizontal shaft 62. Supported on the shaft 62 is a gear 66, which is driven by the gear on the axle of the upper ejection rollers 50. The gear 66 drives, via a further intermediate gear 68, return rollers 70 which are disposed in the housing 18 at about a return output thereof and above the magazine 22.

Figure 2:
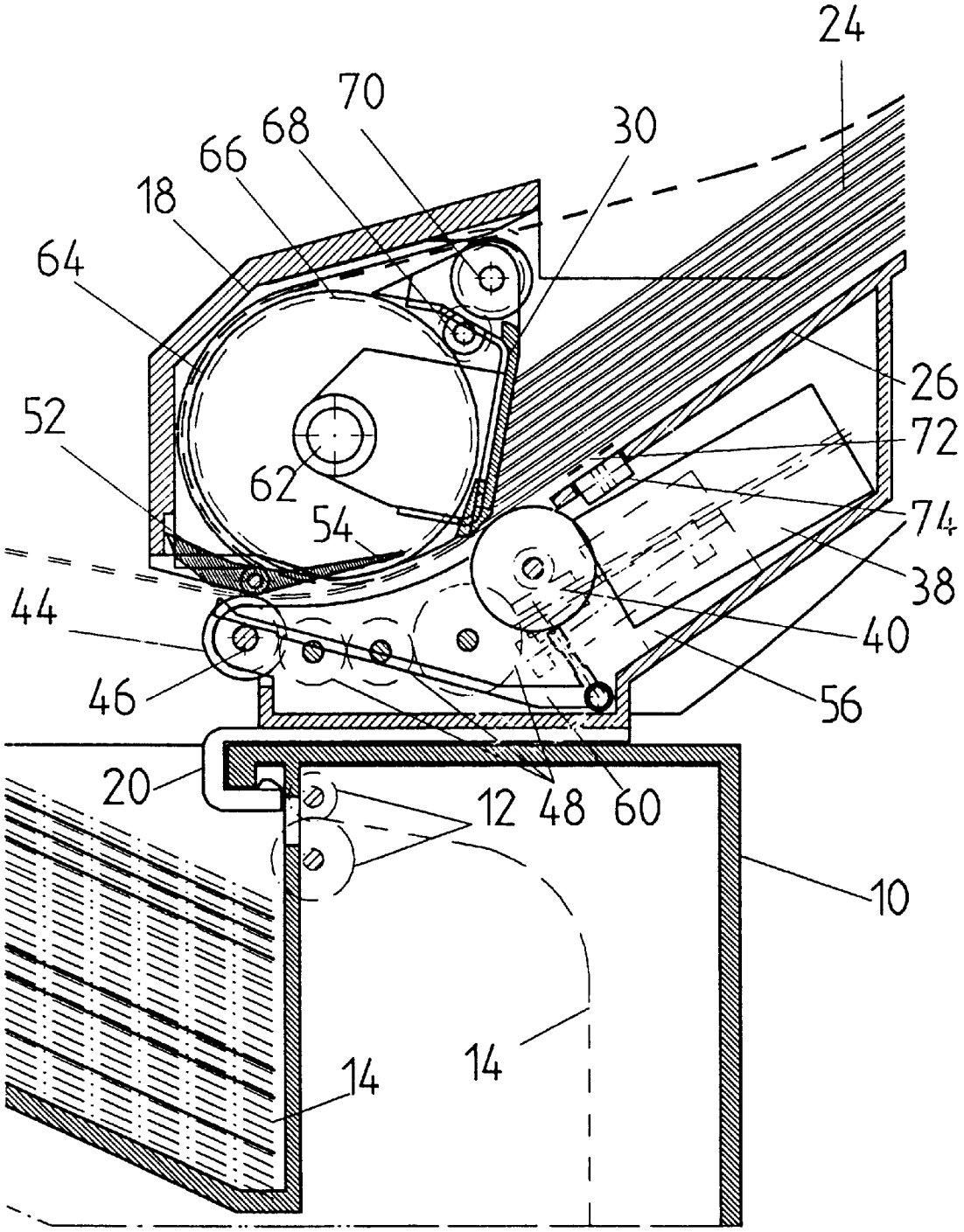
FIG. 2 is an enlarged detail of FIG. 1, wherein a shunt is in an output position.
Figure 3:
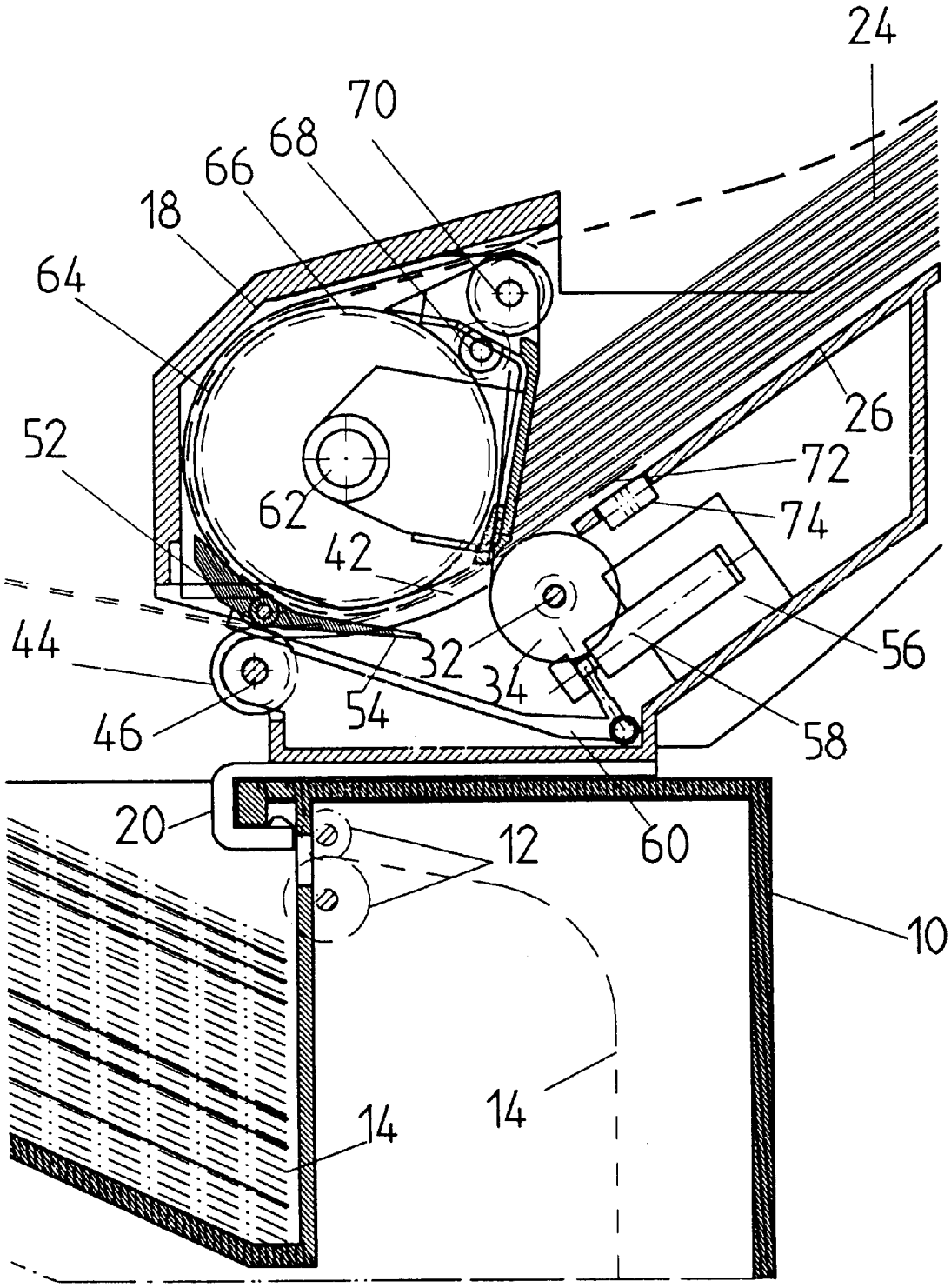
FIG. 3 is a representation corresponding to FIG. 2 wherein the shunt is in a return position.

When the shunt 52 is in an open position as shown in FIG. 2, the tongue 54 is pivoted out of the throughput channel 42 in the upward direction. A spring (not shown) biases the shunt 52 in the open position. Upon the actuation of motor 38, the separating rollers 34 urge the lowermost divider film 24 out from the magazine, and propels the film 24 forward through the throughput channel 42. The divider film 24 passes by the shunt 52 and is gasped between the lower ejection rollers 44 and the upper ejection rollers 50. The rollers 44 and 50 deposit the film 24 onto the stack of sheets 14 already deposited in the stacking tray 16 of printer 10.

When the shunt is in the closed position (FIG. 3) due to the actuation of the electromagnet 56, the shunt 52 is pivoted against the spring force acting thereupon and the tongue 54 is pivoted to extend into the throughput channel 42. A divider film 24, pulled by the separating rollers 34 from the magazine 22 upon actuating the motor 38, enters the throughput channel 42 and engages the shunt 52. The tongue 54 guides the divider film 24 upwardly into the housing 18. The transport rollers 64 urge the divider film 24 through the housing 18 in the upward direction where the divider film 24 is grasped by the return rollers 70, and subsequently returned to the top of the stack of the divider films 24 in magazine 22.

The divider films 24 are circular disk-form flexible synthetic films whose diameter is greater than the dimension of sheets 14. Several different types of divider films 24 are available which differ with respect to their color. In the proximity of their circumferential edge the divider films 24 preferably include an identifying code 72 formed by concentric rings. The identifying code 72 is, for example, coded in the manner of a bar code with a specific identifying code 72 being assigned to each type of divider film 24, for example to each color of the divider films 24.

In the bearing surface 26 of magazine 22 is disposed a sensor 74 whose distance from the stop wall 30 corresponds substantially to the distance of the identifying code 72 from the outer edge of the divider film 24. The sensor 74 scans the identifying code 72 of the lowest divider film 24 which rests on the bearing surface 26. It is thus possible to determine automatically via the sensor 74 and the identifying code 72 the type of the lowest divider film 24.

In use, the printer 10 receives a print command. A control signal is simultaneously supplied to the device. This control signal includes a selection command which indicates the user, or work station assigned to the documents to be printed.

The sensor 74 queries the identifying code 72 of the lowest divider film 24 in the magazine 22. If the identifying code 72 does not correspond to the selection command, the electromagnet 56 receives a signal such that the shunt 52 is pivoted into the closed position shown in FIG. 3. Simultaneously, the motor 38 is started in order to pull the lowest divider film 24 from the magazine 22. This divider film 24 with the non-corresponding identifying code is guided by the shunt 52 upwardly to the transport rollers 64 and the return rollers 70. The divider film 24 is then returned to the top of the stack of divider films 24 in the magazine 22. This process is repeated until the sensor 74 detects an identifying code 72 on a divider film 24 which corresponds to the selection command of the control signal.

Upon the detection of an identifying code corresponding to the selection command, the electromagnet 56 releases the shunt 52 via the angle lever 60. Under spring action, the shunt 52 pivots in the upward direction into the open position shown in FIG. 2. The divider film 24 with the corresponding identifying code passes by the shunt 52, and is ejected via the rollers 44, and 50. The ejected divider film 24 is deposited onto the stack of sheets 14 output by the printer 10. The sheets 14 of the print job corresponding to the selection command are subsequently imprinted and deposited onto the divider film 24. Since the associated sheets 14 in the stack are corresponding to the print job are deposited onto the divider film 24 that identifies their particular association, the associated sheets 14 corresponding to the print job can be readily removed from the stack together with the divider film 24.

It will be understood by one skilled in the art that it is also possible to deposit the divider film 24 associated with a group of sheets 14 on top of the group of sheets 14. This has the advantage that the search for a divider film 24 corresponding to the selection command can take place while the associated print job is being performed. This leads to some savings in time if several divider films 24 must be returned to the magazine 22 while searching for a divider film 24 of the selected type.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A device for separating a stack of sheets ejected by an office machine into sheet groups in accordance with a process request, comprising:

a plurality of divider films, each one of said divider films having identifying information thereon corresponding to a particular process request;

magazine means for storing said divider films to enable said divider films to be deposited on the stack for identifying the sheet groups; and selection means responsive to the process request for selectively retrieving said divider films from said magazine means to enable a selected one of said divider films to be deposited on the stack for each one of the sheet groups;

wherein said selected one of said divider films identifies a particular sheet group corresponding to said particular process request.

2. A device according to claim 1, wherein said identifying information includes coded information indicative of said particular process request.

3. A device according to claim 2, wherein said coded information is a bar code.

4. A device according to claim 2, further including means for sensing said coded information to facilitate the retrieval of said selected one of said divider films.

5. A device according to claim 4, wherein said sensing means includes an optical sensor.

6. A device according to claim 1, further including shunt means for depositing said divider films onto the stack when aid identifying information corresponds to said particular process request, and for returning said divider films to said magazine means when said identifying information does not correspond to said particular process request.

7. A device according to claim 6, further including electromagnetic means responsive to said selection means and operating connected to said shunt means for moving said shunt means between an open position and a closed position.

8. A device according to claim 1, wherein said divider films are substantially circular.

9. A device according to claim 1, wherein said identifying information includes a colored area along the circumferential edge of said divider films indicative of said particular process request.

10. A method for separating a stack of sheets ejected by an office machine into sheet groups in accordance with a process request, comprising:

using a plurality of divider films, each one of said divider films having identifying information thereon corresponding to a particular process request;

storing said plurality of divider films in a magazine;

selectively retrieving said divider films from said magazine in response to the process request;

depositing a selected one of said divider films on the stack for each one of the sheet groups; and, wherein said selected one of said divider films identifies a particular sheet group corresponding to said particular process request.

11. A method according to claim 10, further including using coded information on said divider films, and sensing said coded information to facilitate the retrieval of said selected one of said divider films.

12. A method according to claim 11, further including optically sensing said coded information.

13. A method according to claim 10, further including depositing said divider films onto the stack when said identifying information corresponds to said particular process request, and returning said divider films to said magazine when said identifying information does not correspond to said particular process request.

14. A method according to claim 13, further including moving a shunt between an open position and a closed position.

15. A method according to claim 10, further including depositing said selected one of said divider films directly below said particular sheet group.

16. A method according to claim 10, further including depositing said selected one of said divider films directly above said particular sheet group.

17. In a workgroup including a plurality of workstations coupled to a common central printer, having an output tray, a print job separator, comprising:

a plurality of divider films for separating print jobs based on print job requests received from the plurality of workstations, each one of said divider films having information thereon corresponding to one of the workstations;

magazine means disposed on the central printer above the output tray for storing said divider films; and shunt means coupled to said magazine means for supplying a selected one of said divider films from said magazine means, said information on said selected one of said divider films corresponding to the workstation supplying said print job request.

18. A print job separator according to claim 17, further including sensor means for determining if said information on a lowermost one of said divider films corresponds to said print job request.

19. A print job separator according to claim 17, further including return means for returning said divider films having information that does not correspond to said print job request.

20. A print job separator according to claim 17, wherein each one of said divider films has a color thereon corresponding to one of the workstations.

* * * * *